US006066077A

United States Patent [19]

Horst

[11] Patent Number: 6,066,077

[45] Date of Patent: May 23, 2000

[54] VARIABLE FRICTION RESISTANCE EXERCISE MACHINE

[76] Inventor: Donald J. Horst, 1418 Poplar St., Lebanon, Pa. 17042

[21] Appl. No.: 09/149,343

[22] Filed: Sep. 8, 1998

[51] Int. Cl.[7] ..... A63B 31/012; A63B 21/018

[52] U.S. Cl. ..... 482/114; 482/120

[58] Field of Search ..... 482/114–120, 904, 482/37

[56] References Cited

U.S. PATENT DOCUMENTS

| | | | |
|---|---|---|---|
| 3,782,718 | 1/1974 | Saylor | 482/37 |
| 4,798,378 | 1/1989 | Jones | 482/72 |
| 4,822,032 | 4/1989 | Whitmore et al. | 482/6 X |
| 4,979,733 | 12/1990 | Prud'Hon | 482/116 X |
| 5,133,545 | 7/1992 | Moschetti et al. | 482/115 |
| 5,304,104 | 4/1994 | Chi | 482/1 |
| 5,618,249 | 4/1997 | Marshall | 482/127 |
| 5,762,584 | 6/1998 | Daniels | 482/75 |

*Primary Examiner*—Richard J. Apley
*Assistant Examiner*—Denise Pothier
*Attorney, Agent, or Firm*—Henderson & Sturm LLP

[57] ABSTRACT

A variable friction resistance exercise machine 10 including a pair of friction wheels 31 rotatably suspended by axles 30, 30' in a framework member 20. The axles 30, 30' are operatively connected to coiled lengths 41 of cable attached to one end to clutch rewind assemblies 40. The friction wheels 31 are provided with adjustable friction means 33, 35, 36, 37, and 38 to vary the frictional resistance required to rotate each friction wheel 30, 30' relative to the framework member 20.

4 Claims, 2 Drawing Sheets

VARIABLE FRICTION RESISTANCE EXERCISE MACHINE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable

BACKGROUND OF THE INVENTION

1. Field of the Invention

The present invention relates to the field of exercise machines in general, and a variable friction resistance exercise machine in particular.

2. Description of Related Art

As can be seen by reference to the following U.S. Pat. Nos. 4,346,886; 4,421,307; 5,318,493; and 5,542,898, the prior art is replete with myriad and diverse exercise machines.

While all of the aforementioned prior art constrictions are more than adequate for the basic purpose and function for which they have been specifically designed, they are uniformly deficient with respect to their failure to provide a simple, efficient, and practical variable friction exercise machine wherein the user can be opposed by two resistance mechanisms having different resistance values that the user can selectively set to exercise different groups of muscles.

As a consequence of the foregoing situation, there has existed a longstanding need for a new and improved type of exercise machine employing a plurality of variable friction resistance mechanisms to selectively exercise different muscle groups, and the provision of such a construction is a stated objective of the present invention.

BRIEF SUMMARY OF THE INVENTION

Briefly stated, the variable friction resistance exercise machine that forms the basis of the present invention comprise in general, a framework unit, a friction unit, a clutch unit, and a housing unit.

As will be explained in greater detail further on in the specification, the friction unit and the clutch unit are fixedly secured on axle members that are rotatably suspended on the framework unit. The friction unit comprises a pair of friction wheel members each equipped with a strip of friction material that engages the periphery of the respective wheel and is provided with means for independently tightening and loosening the frictional engagement between the friction strips and the wheels.

In addition, coiled lengths of cable are operatively associated with each axle member to import rotary motion to each friction wheel, which is in turn, resisted by the frictional engagement of each of the friction strips against their respective friction wheel members.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
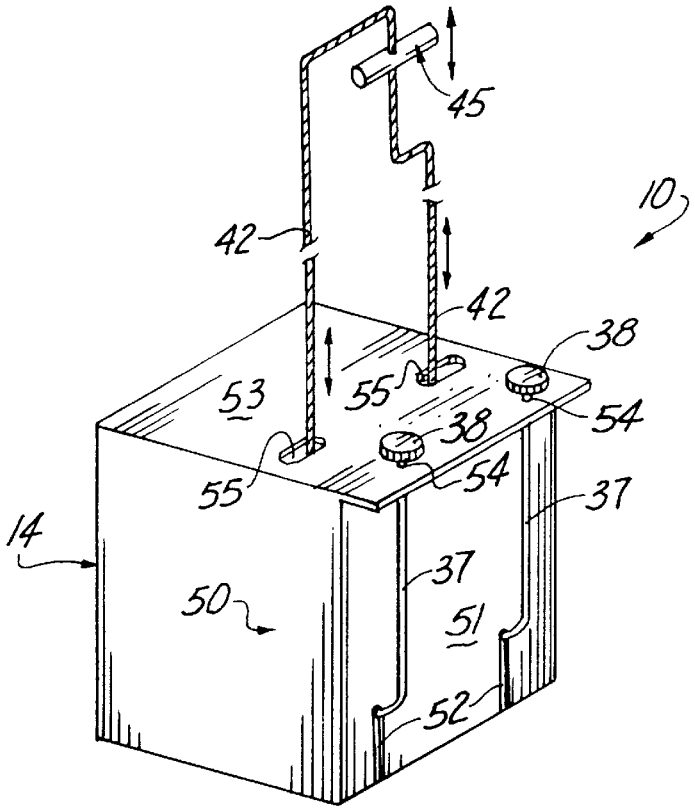
FIG. 1 is a perspective view of the exercise machine housing.
Figure 2:
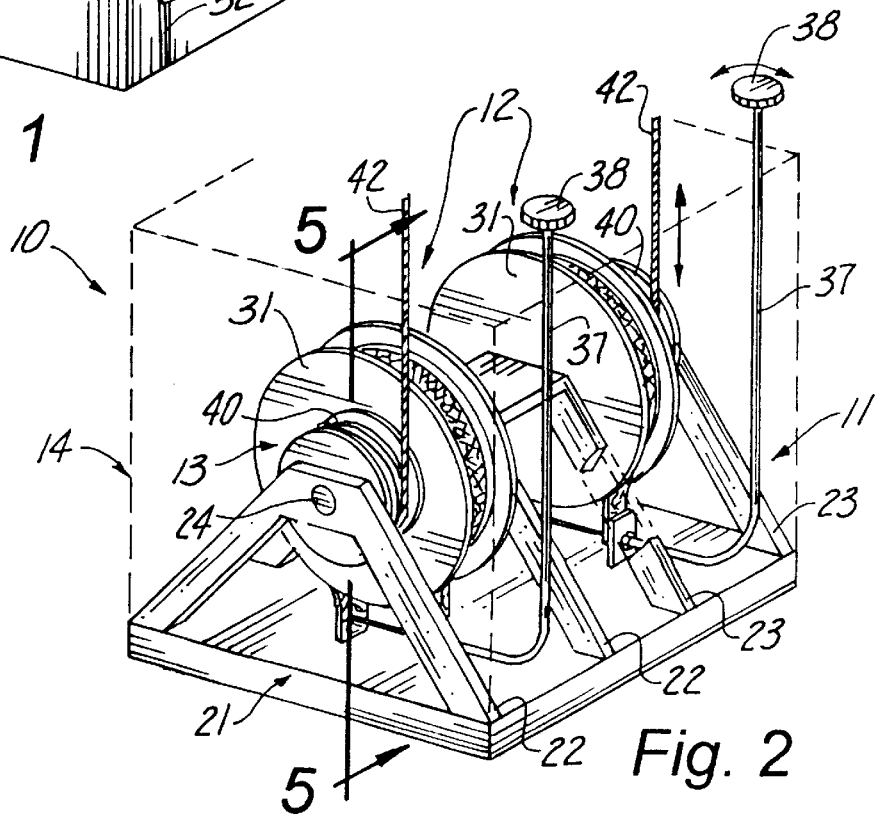
FIG. 2 is a perspective view of the internal components of the exercise machine.

As can be seen by reference to the drawings, and in particularly to FIGS. 1 and 2, the variable friction exercise machine that forms the basis of the present invention is designated generally by the reference number 10. The exercise machine 10 comprises a framework unit 11, an adjustable friction unit 12, a clutch unit 13, and a housing unit 14. These units will now be described in seriatim fashion.

Figure 3:
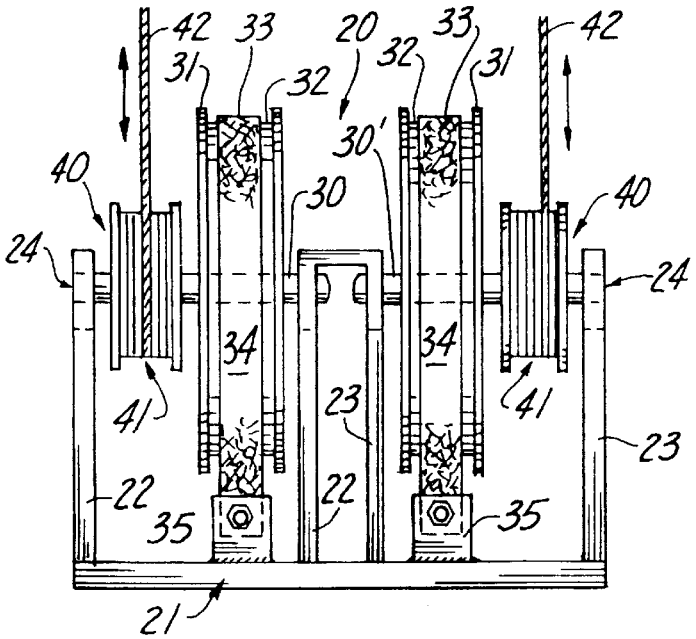
FIG. 3 is a cross sectional view taken through line 3—3 of FIG. 2.
Figure 4:
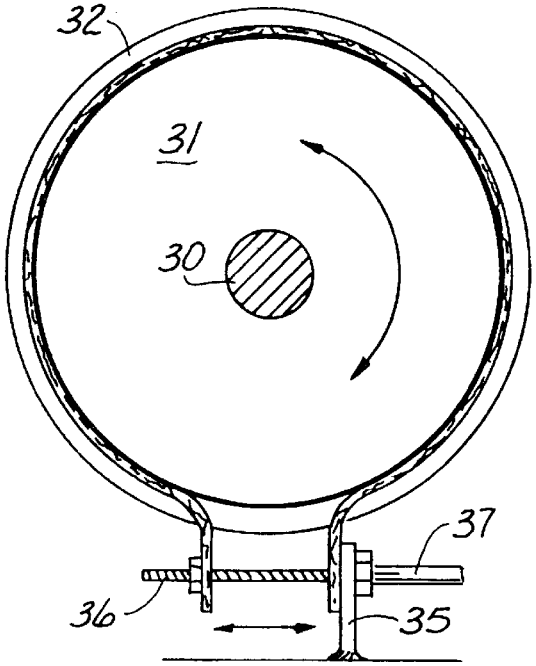
FIG. 4 is an isolated side view of the friction wheel adjustment mechanism.

As shown in FIGS. 2 and 3, the framework unit 11 comprises framework member 20 including a generally rectangular base 21 having two pairs of vertical support elements 22, 22, 23, 23, having opposed apertures 24 formed on their upper ends for reasons that will be explained presently.

Turning now to FIGS. 2 through 5, it can be seen that the friction unit 12 comprises a pair of axle members 30, 30' wherein each axle member 30 is rotatably received in the opposed apertures 24 in one of the pairs of vertical support elements 22, 22 and 23, 23.

In addition, each axle member 30, 30' is provided with a friction wheel member 31 which is fixedly secured to the respective axle members 30, 30'. Each friction wheel member 31 is provided with a peripheral groove 32 dimensioned to receive a strip 33 of high friction material 34 wherein one end of the friction strip 33 is fixedly secured in a bracket 35 mounted on the base 21 of the framework member 20. The other end of the friction strip 33 is attached to an adjustable length cable 36 that passes through the bracket 35 and into a cable sheath 37 provided with an adjustment knob 38 to shorten or lengthen the effective length of the cable 36 in a well recognized manner.

Figure 5:
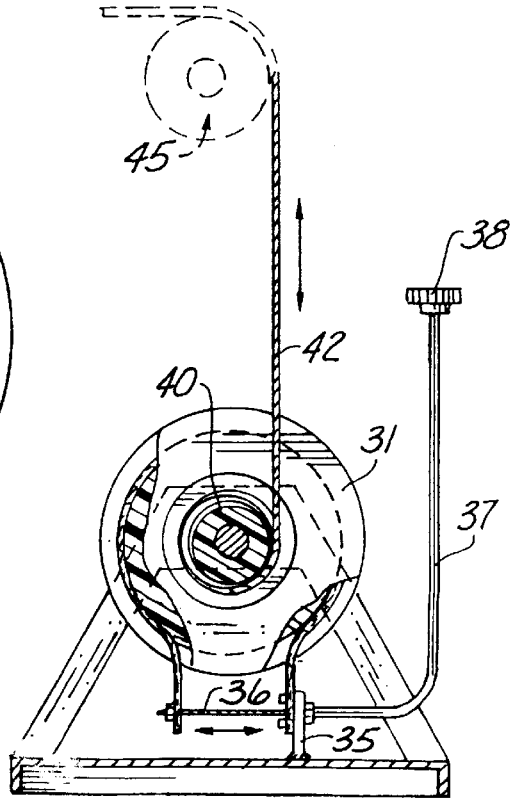
FIG. 5 is a partial cut away view showing the cable clutch and resistance adjustment mechanism.

As shown in FIGS. 2, 3, and 5, the clutch unit 13 comprises a pair of one way clutch rewind assemblies 40 which are fixedly secured to the axle members 30, 30'. Each clutch rewind assembly 40 has a coiled supply 41 of cable 42 which passes over a pulley array 43 to provide a force multiplier for the exercise machine 10 in a well recognized fashion.

As shown in FIGS. 1 and 2, the housing unit 14 comprises a generally rectangular housing member 50 dimensioned to cover the framework unit 11 and having a sidewall 51 provided with a pair of slots 52 dimensioned to receive the cable sheath 37 and a top panel 53 which overhangs the slotted sidewall 51 and is provided with one pair of apertures 54 dimensioned to receive the adjustment knobs 38 and another pair of apertures 55 dimensioned to receive the ends of one or more lengths of cable 42.

In the preferred embodiment of the invention depicted in FIGS. 1 and 5, the outboard end of each length of cable 42 is further provided with a connector element 45.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following c aims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A variable friction resistance exercise machine consisting of:

a framework unit including a base having first and second pairs of vertical support elements;

a friction unit including first and second axle members rotatably supported by said first and second pairs of vertical support elements, first and second friction wheel members fixedly secured to said first and second axle members; first and second coiled lengths of cable having a first end operatively associated with said first and second axle members and adapted to impart rotary motion to said first and second axle members by a force applied to the second end of said first and second coiled lengths of cable;

first and second adjustable friction means for resisting the rotation respectively of said first and second axle members wherein said first and second adjustable friction means comprise: first and second brackets mounted on said base; first and second strips of friction material disposed respectively on the periphery of said first and second wheel members and having one end fixedly secured to said first and second brackets;

first and second adjustable lengths of cable attached to the other end of said first and second strips of friction material; and a connector element connecting the second end of the first and second coiled lengths of cable to one another; and a clutch unit comprising first and second clutch rewind assemblies fixedly secured respectively to said first and second axle members.

2. The exercise machine as in claim 1 further comprising:

first and second cable sheaths dimensioned to receive the other end of the first and second adjustable lengths of cable, wherein the first and second cable sheaths are secured respectively to said first and second brackets.

3. The exercise machine as in claim 2 further comprising:

first and second adjustment knobs attached to the other end of said first and second adjustable length cable.

4. The exercise device as in claim 1 wherein the first end of said first and second coiled lengths of cable are operatively connected respectively to said first and second clutch rewind assemblies.

* * * * *